US009394801B2

(12) United States Patent
Willett, Jr.

(10) Patent No.: US 9,394,801 B2
(45) Date of Patent: Jul. 19, 2016

(54) ADJUSTABLE TURBINE SEAL AND METHOD OF ASSEMBLING SAME

(71) Applicant: General Electric Company, Schenectady, NY (US)

(72) Inventor: Fred Thomas Willett, Jr., Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 495 days.

(21) Appl. No.: 14/047,513

(22) Filed: Oct. 7, 2013

(65) Prior Publication Data

US 2015/0098807 A1 Apr. 9, 2015

(51) Int. Cl.

| | |
|---|---|
| ***F01D 11/22*** | (2006.01) |
| ***F01D 11/14*** | (2006.01) |
| ***F01D 11/16*** | (2006.01) |

(52) U.S. Cl.

CPC ..... *F01D 11/14* (2013.01); *F01D 11/16* (2013.01); *F01D 11/22* (2013.01); *F05D 2260/30* (2013.01); *Y10T 29/49229* (2015.01)

(58) Field of Classification Search

CPC ..... F01D 11/22; F05D 2260/30

See application file for complete search history.

(56) References Cited

U.S. PATENT DOCUMENTS

| | | | | |
|---|---|---|---|---|
| 3,085,398 | A * | 4/1963 | Ingleson | F01D 11/22 415/127 |
| 3,227,418 | A * | 1/1966 | West | F01D 11/22 415/127 |
| 4,343,592 | A * | 8/1982 | May | F01D 11/22 415/127 |
| 4,598,565 | A | 7/1986 | Weddle | |
| 5,002,288 | A | 3/1991 | Morrison et al. | |
| 5,228,828 | A | 7/1993 | Damlis et al. | |
| 5,344,284 | A | 9/1994 | Delvaux et al. | |
| 5,362,072 | A | 11/1994 | Dalton | |
| 5,374,068 | A | 12/1994 | Jewett et al. | |
| 5,971,400 | A | 10/1999 | Turnquist et al. | |
| 6,027,121 | A | 2/2000 | Cromer et al. | |
| 6,045,134 | A | 4/2000 | Turnquist et al. | |
| 6,340,286 | B1 | 1/2002 | Aksit et al. | |
| 6,896,482 | B2 | 5/2005 | Parry | |
| 7,287,956 | B2 | 10/2007 | Bracken et al. | |
| 7,306,428 | B2 | 12/2007 | Schiebold et al. | |
| 7,575,409 | B2 * | 8/2009 | Dierksmeier | F01D 11/22 415/1 |
| 2012/0177483 | A1 | 7/2012 | Ali et al. | |
| 2012/0315138 | A1 | 12/2012 | Rao et al. | |

* cited by examiner

*Primary Examiner* — Ninh H Nguyen

(74) *Attorney, Agent, or Firm* — Armstrong Teasdale LLP

(57) ABSTRACT

A system for providing sealing in a turbine is provided. The sealing system includes a retaining channel oriented within a housing structure proximate a moving turbine component. A seal member is coupled within the retaining channel. A first end of the seal member is secured to the housing structure. A second end of the seal member is movable relative to the retaining channel between first and second positions corresponding to a transient operational mode and a steady state operational mode, respectively. The transient operational mode defines a first clearance between the seal member and the moving turbine component. The steady state configuration defines a second clearance that is smaller than the first clearance. A take-up device coupled to the second end of the seal member moves the second end between the first and second positions.

20 Claims, 7 Drawing Sheets

ADJUSTABLE TURBINE SEAL AND METHOD OF ASSEMBLING SAME

BACKGROUND

The present disclosure relates to turbomachinery, and more particularly, to adjustable seals for use in steam turbines.

At least some known steam turbines include seals that extend between tips of turbine rotor blades and inner surfaces of shrouds that surround the turbine blades. Known steam turbines experience several different phases of operation including, but not limited to, start-up, warm-up, steady state, shutdown, and cool-down. In at least some of such known steam turbines, for optimal efficiency, clearances between the turbine rotor blade tips and the inner surfaces of the shrouds should be kept as tight as possible during each phase of operation of the steam turbine. However, the clearances may vary as the steam turbine transitions from one operational phase to another. More particularly, each operational phase has different operating conditions associated with it, such as temperature, pressure, and rotational speed, which may cause changes in the clearances between steam turbine components, including static and moving components within the steam turbine.

In at least some known steam turbines, to prevent moving components from contacting static components and causing contact-related damage as the steam turbine transitions between phases of operation, the clearances are intentionally increased. For example, in at least some known steam turbines, cold, or assembly, clearances are set to be larger than required for steady-state operation because clearance gap closure is greater during transient operational phases, such as start-up, warm-up, shutdown and cool-down operational phases, than during steady-state operation. In addition, in at least some known steam turbines, larger clearances are provided to facilitate assembly of the steam turbine.

BRIEF DESCRIPTION

In an aspect, a method for providing a seal for use in a turbine is provided. The method includes coupling a housing structure within the turbine such that at least one retaining channel is defined adjacent to a moving turbine component coupled within the turbine. The method also includes coupling a seal member within the at least one retaining channel such that a first end of the seal member is secured to the housing structure and such that a second end of the seal member is movable relative to the at least one retaining channel between a first position and at least a second position, wherein a first clearance is defined between the seal member and the moving turbine component when in the first position, and a second clearance is defined between the seal member and the moving turbine component, when in the second position, wherein the first clearance is larger than the second clearance. The method also includes coupling a take-up device to the second end of the seal member, to selectively move the second end between the first and second positions.

In another aspect, a system for providing sealing in a turbine is provided. The system includes a housing structure coupled within the turbine such that at least one retaining channel is defined adjacent to a moving turbine component coupled within the turbine. The system also includes a seal member coupled within the at least one retaining channel such that a first end of the seal member is secured to the housing structure and such that a second end of the seal member is movable relative to the at least one retaining channel between a first position and at least a second position, wherein a first clearance is defined between the seal member and the moving turbine component when in the first position, and a second clearance is defined between the seal member and the moving turbine component, when in the second position, wherein the first clearance is larger than the second clearance. The system also includes a take-up device coupled to the second end of the seal member, to selectively move the second end between the first and second positions.

In another aspect, a turbine system is provided. The turbine system includes a source of steam, and a steam turbine coupled to the source of steam, wherein the steam turbine includes a housing, a rotor coupled for rotation within the housing, and at least one rotor blade coupled to the rotor. A load is coupled to the rotor. The steam turbine includes a sub-system for providing sealing. The sub-system includes a housing structure coupled within the turbine such that at least one retaining channel is defined adjacent to a moving turbine component coupled within the turbine. The sub-system also includes a seal member coupled within the at least one retaining channel such that a first end of the seal member is secured to the housing structure and such that a second end of the seal member is movable relative to the at least one retaining channel between a first position and at least a second position, wherein a first clearance is defined between the seal member and the moving turbine component when in the first position, and a second clearance is defined between the seal member and the moving turbine component, when in the second position, wherein the first clearance is larger than the second clearance. The sub-system also includes a take-up device coupled to the second end of the seal member, to selectively move the second end between the first and second positions.

DETAILED DESCRIPTION

As used herein, the terms "axial" and "axially" refer to directions and orientations that extend substantially parallel to a longitudinal axis of a steam turbine. Moreover, the terms "radial" and "radially" refer to directions and orientations that extend substantially perpendicular to the longitudinal axis of the steam turbine. In addition, as used herein, the terms "circumferential" and "circumferentially" refer to directions and orientations that extend arcuately about the longitudinal axis of the steam turbine. It should also be appreciated that the term "fluid" as used herein includes any medium or material that flows, including, but not limited to, air, gas, liquid and steam.

Figure 1:
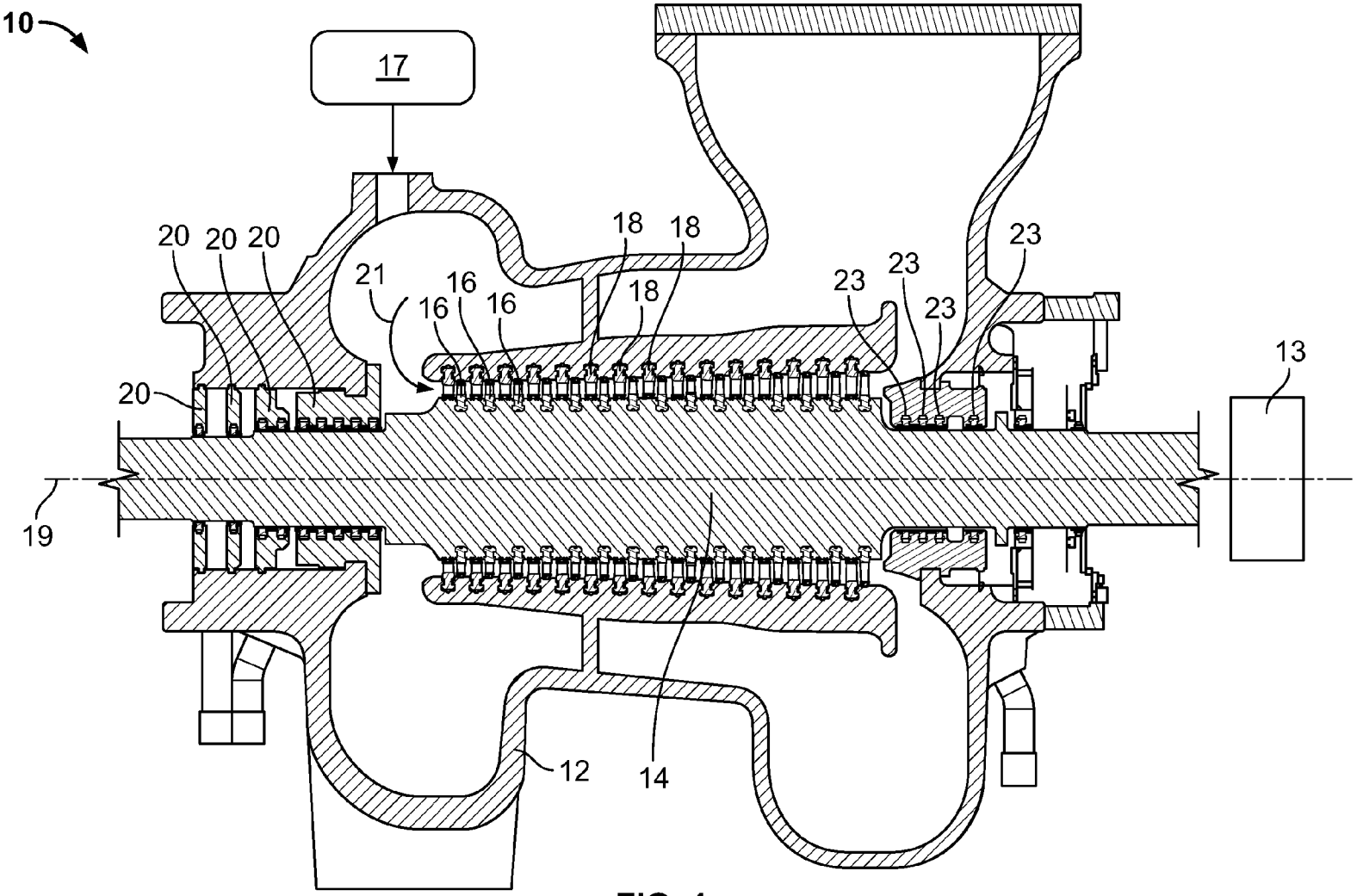
FIG. 1 is a schematic illustration of an exemplary steam turbine.
Figure 2:
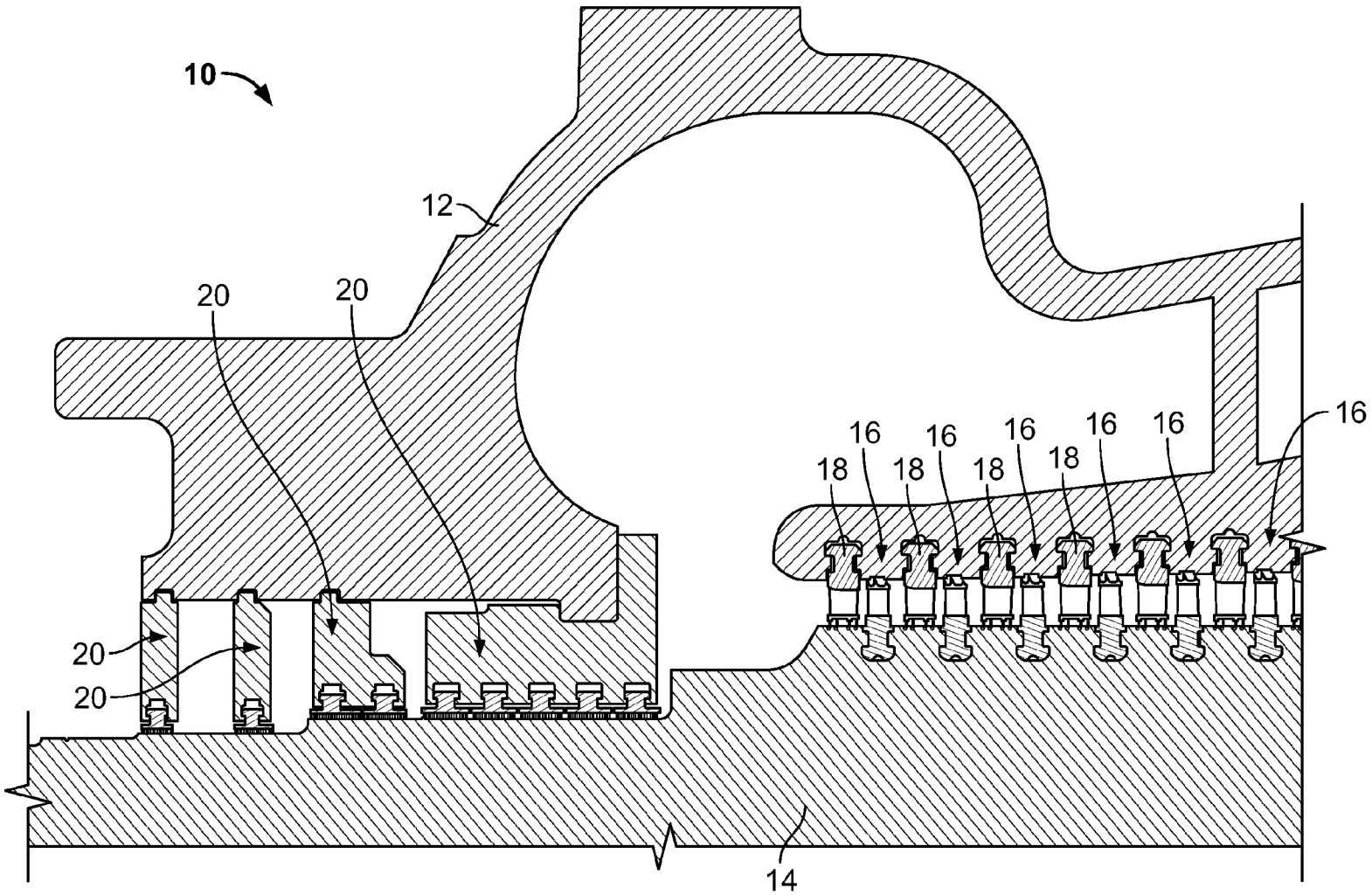
FIG. 2 is an enlarged view of the steam turbine shown in FIG. 1.

FIG. 1 is a schematic illustration of an exemplary steam turbine 10. Turbine 10 includes a housing 12 and a rotor 14 coupled for rotation within housing 12 about a longitudinal axis 19. Rotor 14 is coupled to a load 13, which may be, for example, an electrical generator. FIG. 2 is an enlarged view of steam turbine 10, illustrating a plurality of rotor blades 16 and turbine nozzles 18. Rotor blades 16 are coupled to rotor 14 for rotation with rotor 14. Nozzles 18 are coupled to housing 12, such that nozzles 18 are oriented in alternation with turbine rotor blades 16. Accordingly, as a flow 21 of steam from a steam source 17 is channeled through turbine 10, flow 21 passes nozzles 18 and turbine rotor blades 16 in alternating succession. End packings 20 and 23 facilitate preventing steam from escaping housing 12. In the exemplary embodiment, steam turbine 10 may have any suitable configuration that enables steam turbine 10 to function as described herein.

Figure 3:
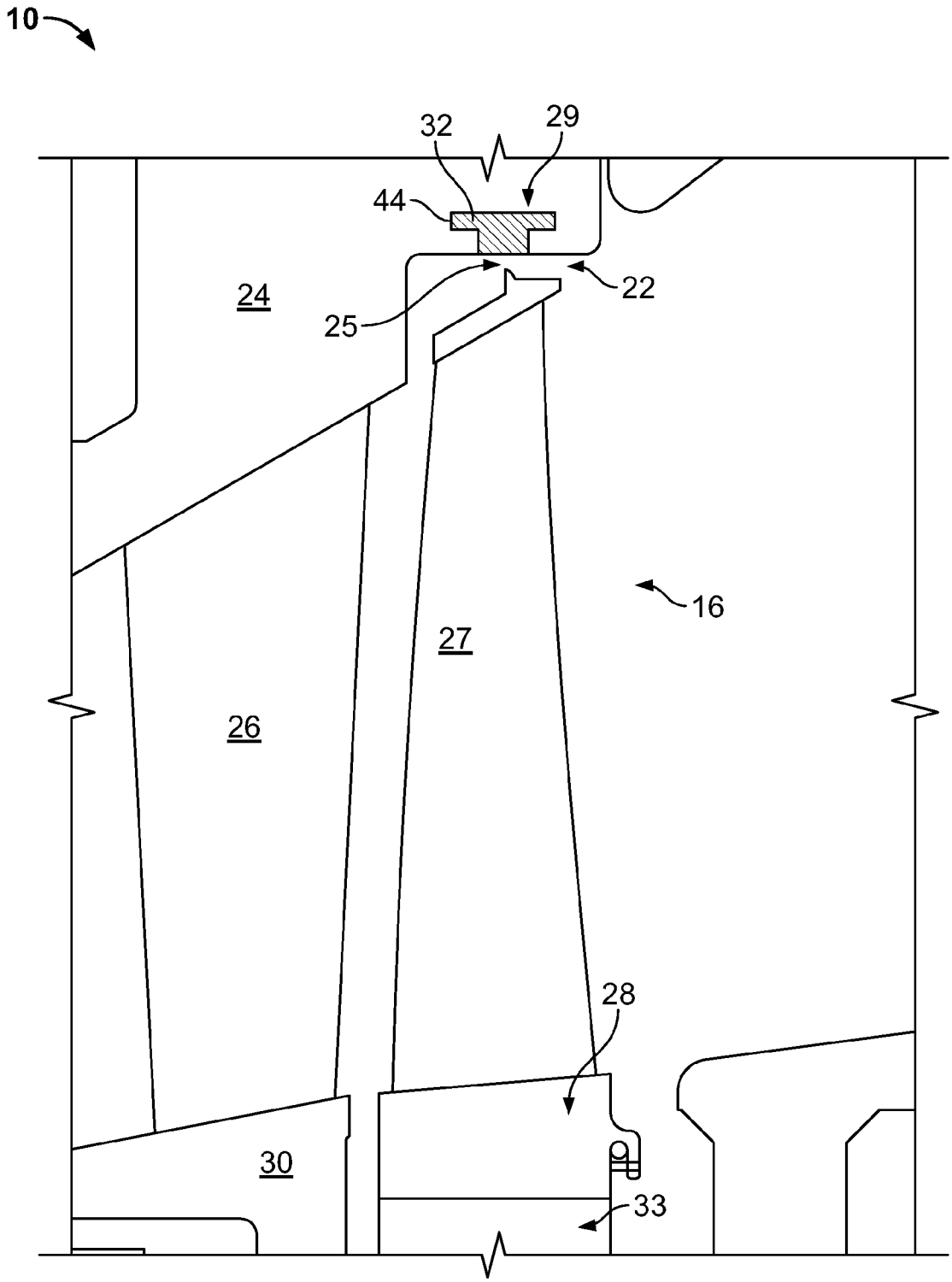
FIG. 3 is an enlarged view of an exemplary turbine rotor blade that may be used in the steam turbine shown in FIG. 1.

FIG. 3 is an enlarged view of a turbine rotor blade 16 that may be used in steam turbine 10 shown in FIG. 1. In the exemplary embodiment, rotor blade 16 (also called a bucket) includes an airfoil 27 and a dovetail 28, which is coupled to a rotor disk 33. Rotor disk 33 is coupled for rotation with rotor 14 (shown in FIG. 1). Each nozzle 18 includes a vane 26 coupled to stator structures 24 (also referred to as an outer ring) and 30 (also referred to as an inner ring and diaphragm) within housing 12. Each vane 26 remains stationary relative to rotor 14. FIG. 3 illustrates an exemplary clearance 22 between a tip 25 of airfoil 27 and stator structure 24. As previously described, components such as housing 12, structures 24 and 30, vane 26 and airfoil 27 heat up and expand, as steam turbine 10 transitions from a transient operational phase (for example, a start-up phase and a warm-up phase) to a steady-state operational phase. As a result, in at least some known turbines 10, clearance 22 will increase. FIG. 3 also illustrates an exemplary adjustable sealing system 29 oriented within stator structure 24 to accommodate variations in clearance 22 during operation of steam turbine 10. Adjustable sealing system 29 includes a seal member 32 oriented within a retaining channel 44 defined in stator structure 24. In the exemplary embodiment, seal member 32 may have any configuration that enables system 29 to function as described herein.

Figure 4:
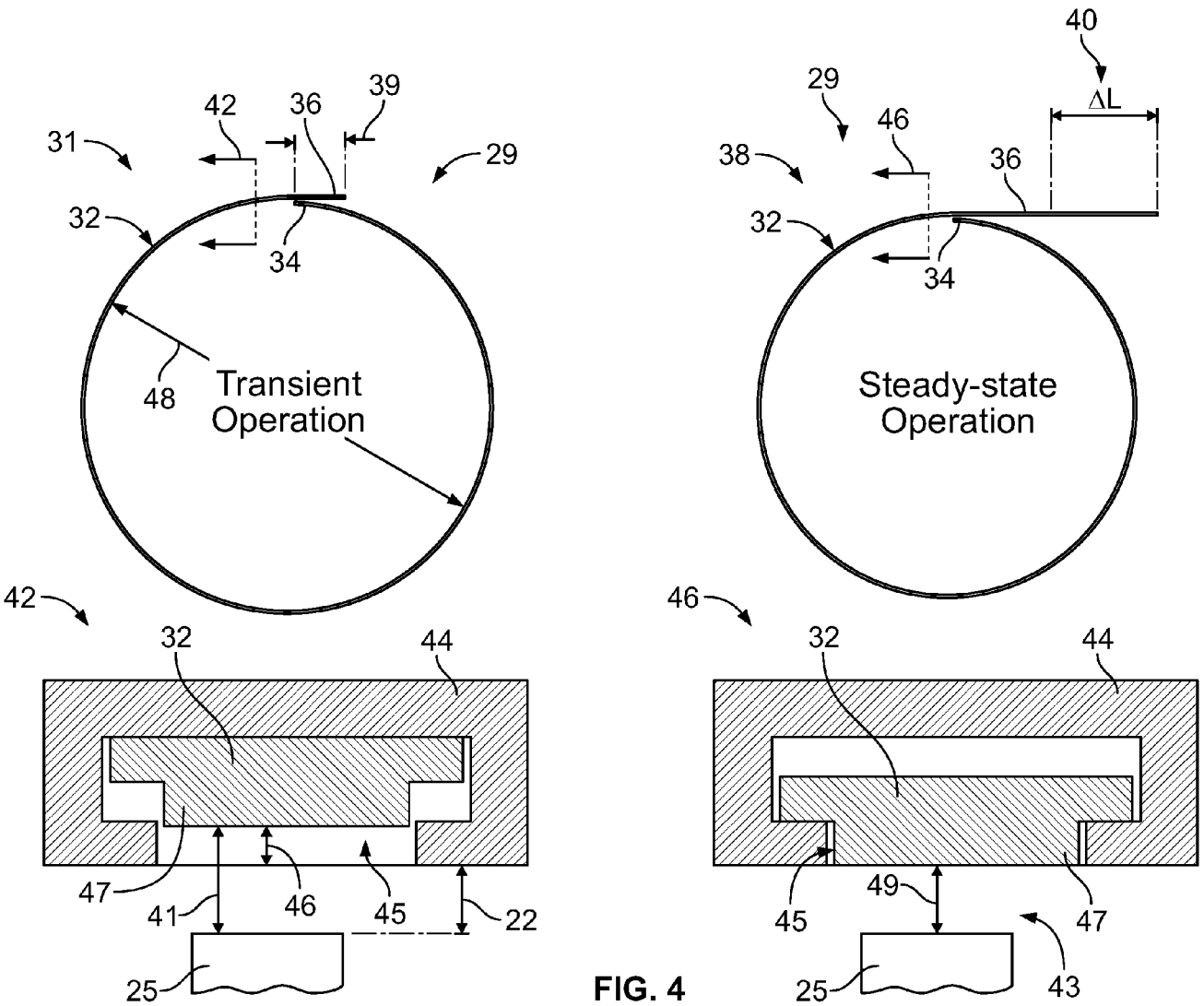
FIG. 4 is a schematic illustration of an exemplary adjustable sealing system that may be used in the steam turbine shown in FIG. 1.

FIG. 4 is a schematic illustration of an exemplary adjustable sealing system 29 (shown in FIG. 3) that may be used in steam turbine 10 (shown in FIG. 1). In a transient operational mode 31, seal member 32 is oriented in a radially outward orientation within retaining channel 44 that defines a clearance 41 between rotor blade tip 25 and seal member 32. Clearance 41 is larger than clearance 22. In the exemplary embodiment, transient operational mode 31 exists in steam turbine 10 during transient phases of operation, such as start-up and warm-up operations. In the exemplary embodiment, seal member 32 is a discontinuous loop that includes overlapping ends 34 and 36. When turbine 10 is in transient operational mode 31, seal member ends 34 and 36 overlap by a distance 39. During transient operational mode 31, seal member 32 is oriented within retaining channel 44 such that seal member 32 is spaced a distance 46 from an opening 45 of retaining channel 44. In the exemplary embodiment, seal member 32 has a "T"-shaped cross-section, as seen in cross-sectional view 42. In an alternative embodiment, seal member 32 and retaining channel 44 may have any suitable configurations that enable sealing system 29 to function as described herein.

In the exemplary embodiment, seal member end 34 is secured in a fixed position relative to retaining channel 44, while end 36 is coupled to a take-up device (not shown). To shift seal member 32 from transient operational mode 31 to a steady state operational mode 38, end 36 is pulled by the take-up device to increase the overlap of ends 34 and 36 by a distance ΔL 40. As distance ΔL 40 is increased, a diameter 48 of looped seal member 32 is decreased simultaneously. In the exemplary embodiment, ΔL 40 may be any distance that enables sealing system 29 to function as described herein. As end 36 is pulled, seal member 32 is also prompted radially inwardly towards opening 45 such that a portion 47 of seal member 32 enters opening 45, such that a second clearance 43 is defined that is smaller than clearance 41. To shift sealing system 29 from the steady state operational mode 38 to transient operational mode 31, a reverse process is used wherein end 36 is pushed to decrease the overlap of ends 34 and 36. In the exemplary embodiment, clearance 43 is approximately the same as clearance 22. In an alternative embodiment, clearance 43 may be any distance that enables sealing system 29 to function as described herein.

Figure 5:
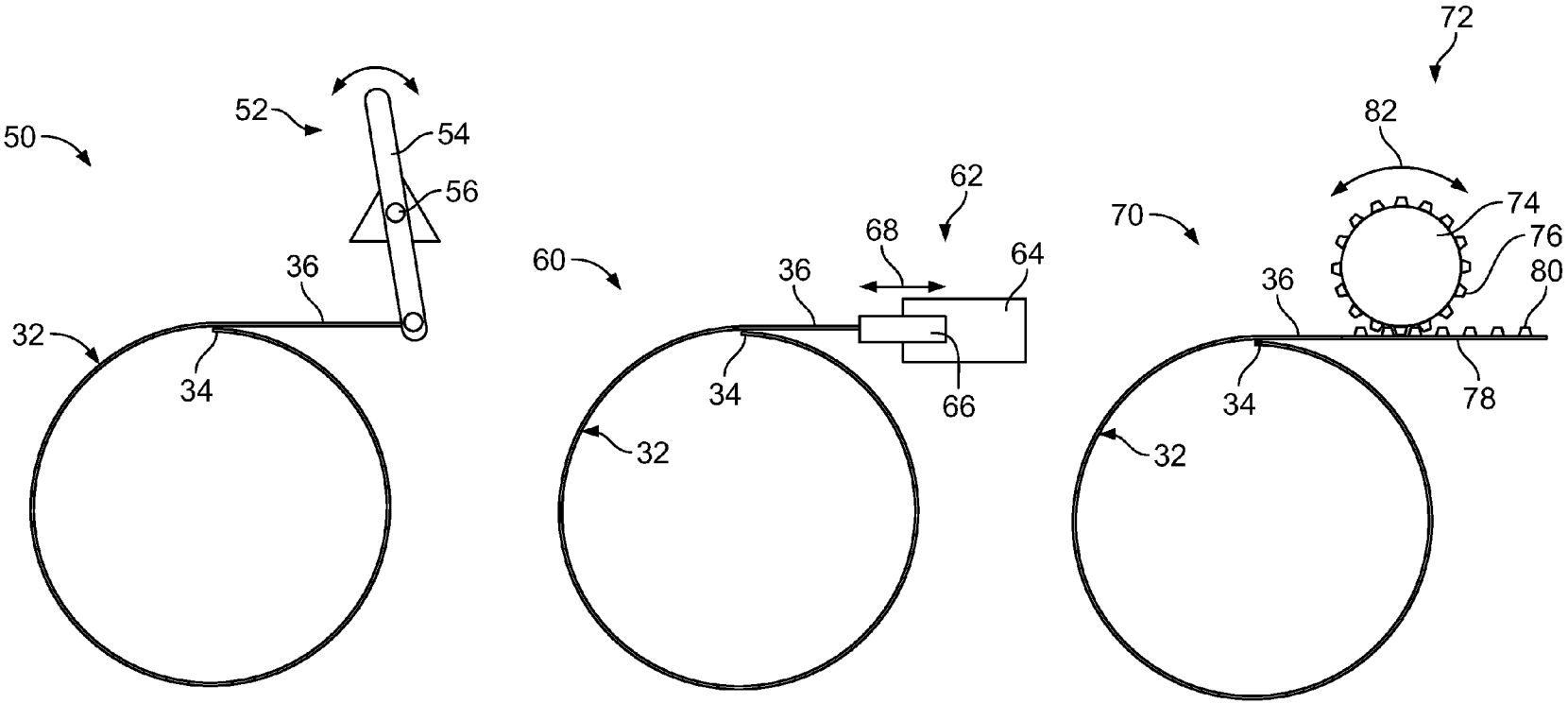
FIG. 5 is a schematic illustration of exemplary take-up devices that may be used in the adjustable sealing system shown in FIG. 4.

FIG. 5 is a schematic illustration of alternative exemplary take-up devices 50, 60, and 70 that may be used with sealing system 29 (shown in FIG. 3) to selectively shift sealing system 29 between modes 31 and 38. In the exemplary embodiment, each take-up device 50, 60, and 70 may be coupled to seal member 32 in retaining channel 44 (shown in FIG. 3). For example, take-up device 50 includes a lever assembly 52 that is coupled to stator structure 24 (shown in FIG. 30). Within assembly 52, a lever 54 is coupled to seal member end 36 and is supported for pivotal movement about an axis 56. In the exemplary embodiment, lever 54 may be actuated using any suitable actuation device (not shown) that enables take-up device 50 to function as described herein. In an alternative embodiment (not shown), lever assembly 52 may include a clamping device (not shown) similar to a Marmon clamp, for enabling lever 54 to be releasably locked into one or more positions.

Take-up device 60 includes a linear actuator 62 coupled to stator structure 24 (shown in FIG. 3). In the exemplary embodiment, linear actuator 62 includes a cylinder 64 and a cooperating piston 66. Piston 66 is movable in a reciprocating manner in the direction of arrow 68 relative to cylinder 64, and is coupled to seal member end 36. In the exemplary embodiment, linear actuator 62 may be operated using any suitable medium that enables linear actuator 62 to function as described herein, such as, not limited to, compressed air or hydraulic fluid.

Take-up device 70 is coupled to stator structure 24 (shown in FIG. 3), and includes a sprocket assembly 72. Sprocket assembly 72 includes a sprocket 74 that includes a plurality of teeth 76, and a toothed rack 78 that is coupled to seal member end 36. When an actuator (not shown) rotates sprocket 74 in a direction indicated by an arrow 82, teeth 76 on sprocket 74 engage a plurality of teeth 80 on toothed rack 78, and move rack 78 to tighten or loosen seal member 32, depending on the direction of rotation of sprocket 74.

Take-up devices 50, 60, and 70 each selectively move free end 36 of seal member 32, so as to increase an amount of overlap in seal member 32, and to decrease the circumference and diameter of the loop formed by seal member 32. Accordingly, seal member 32 is pulled radially inwardly within retaining channel 44 to decrease clearance 22 (shown in FIG. 3), to shift sealing system 29 from transient operational mode 31 (shown in FIG. 4) to steady state operational mode 38 (shown in FIG. 4). To shift sealing system 29 from steady state operational mode 38 to transient operational mode 31, the procedures described above are reversed, to push free end 36 of seal member 32 such that the amount of overlap is decreased. Take-up devices 50, 60, and 70 are exemplary only, and the present disclosure is not limited thereto. In an alternative embodiment, each device 50, 60, and/or 70 may have any suitable configuration that enables sealing system 29 to function as described herein.

Figure 6:
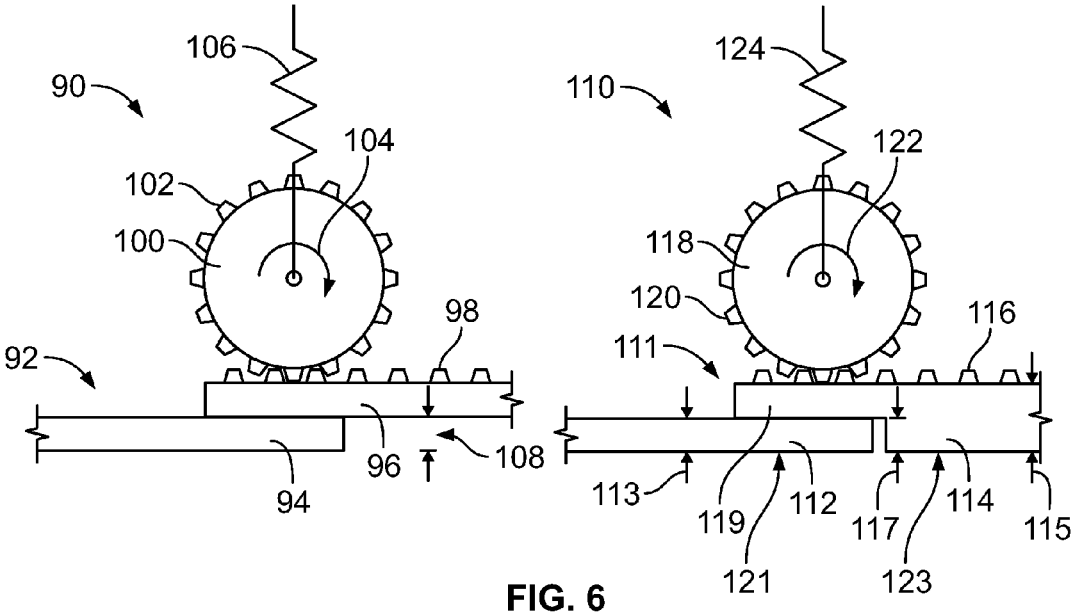
FIG. 6 is a schematic illustration of an alternative take-up device that may be used in the adjustable sealing system shown in FIG. 4.

Each device 50, 60, and/or 70 involves the overlap of seal member ends 34 and 36. FIG. 6 is a schematic illustration of alternative sealing systems 90 and 110 that address seal member end overlap. In system 90, seal member 92 includes overlapping seal member ends 94 and 96, and is oriented within a retaining channel (not shown) that is the same or similar to retaining channel 44 of sealing system 29 (shown in FIG. 3). In such an embodiment, seal member 92 has a configuration that is the same or similar to that of seal member 32 in sealing system 29 (shown in FIG. 3). In an alternative embodiment, seal member 92 may have any configuration that enables sealing system 90 to function as described herein.

In the exemplary embodiment, system 90 includes a take-up device similar to take-up device 70 (shown in FIG. 5). Specifically, a sprocket 100 is coupled to stator structure 24 (shown in FIG. 3). Sprocket 100 includes teeth 102 that engage a plurality of teeth 98 on seal member end 96. When sprocket 100 is rotated by an actuator (not shown) in a direction indicated by an arrow 104, seal member end 96 is drawn toward seal member end 94. Seal member 92 is moved radially inwardly within the retaining channel to shift seal member 92 into a steady state operational mode. A spring element 106 exerts a radially inwardly-directed compressive force on sprocket 100, to maintain seal member ends 94 and 96 in contact with each other. However, sealing system 90 includes an offset 108 where seal member 92 does not contact the retaining channel, even when seal member is in steady state operational mode 38 (shown in FIG. 3).

An alternative sealing system 110 addresses offset 108 in sealing system 90. In the exemplary embodiment, sealing system 110 includes a seal member 111 in a retaining channel (not shown) that is the same or similar to retaining channel 44 of sealing system 29 (shown in FIG. 3). A seal member end 112 includes a thickness 113 that is less than a thickness 115 of an opposite seal member end 114. Seal member end 114 also includes an offset 117, and a tab 119 that overlaps seal member end 112. As a result, a radially inner surface 121 of seal member end 112 remains substantially flush with a radially inner surface 123 of seal member end 114 in both transient and steady state operational modes. Sealing system 110 includes a sprocket 118 that includes a plurality of teeth 120, which engage a plurality of teeth 116 on seal member end 114.

Accordingly, when an actuator (not shown) rotates sprocket 118 in a direction indicated by an arrow 122, seal member 111 is tightened, to prompt sealing system 110 into a steady state operational mode. To prompt sealing system 110 into a transient operational mode, sprocket 118 is rotated in a direction opposite to arrow 122. Sealing system 110 also includes a spring element 124 that pushes radially inwardly against sprocket 118 such that tab 119 is maintained in contact with end 112. Sealing system 110 addresses offset 108 by providing seal member 111 with different end thicknesses 113 and 115. As a result, inner surfaces 121 and 123 remain substantially flush with each other in both transient operational mode 31 and steady state operational mode 38 (shown in FIG. 4). In the exemplary embodiment, except as described hereinabove, seal member 111 is substantially similar to seal member 32 (shown in FIG. 4). In an alternative embodiment, seal member 111 may have any configuration that enables sealing system 110 to function as described herein.

Figure 7:
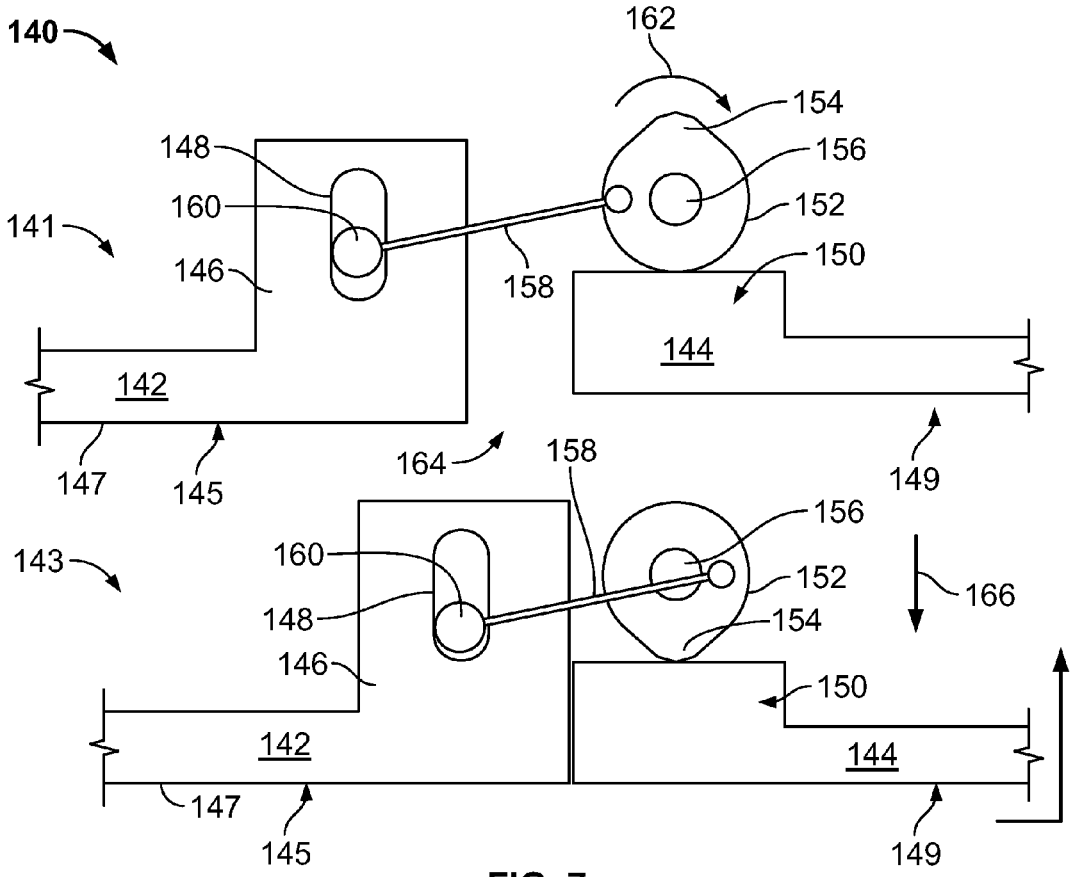
FIG. 7 is a schematic illustration of another alternative take-up device that may be used in the adjustable sealing system shown in FIG. 4.

FIG. 7 is a schematic illustration of another alternative sealing system 140. In the exemplary embodiment, a seal member 147, that includes non-overlapping ends 142 and 144, fits in a retaining channel (not shown) that is the same or similar to retaining channel 44 of sealing system 29 (shown in FIG. 3). Seal member end 144 is secured against circumferential movement relative to the retaining channel, and includes a tab 150. Seal member end 142 is movable circumferentially and radially relative to the retaining channel, and includes a tab 146. A pin 160 is slidably movable in a slot 148 in tab 146. A cam 152 is coupled to a housing structure (not shown) and to seal member end 144, and is rotatable around a pin 156 in a direction indicated by an arrow 162. Pin 156 is radially fixed relative to end 144. Cam 152 includes an eccentric lobe 154, and is coupled to pin 160 via a link 158.

When sealing system 140 is in a transient operational mode 141, seal member ends 142 and 144 are separated by a gap 164. In addition, a seal member inner surface 145 is offset radially from a seal member inner surface 149. To shift seal member 147 from transient operational mode 141 to a steady state operational mode 143, an actuator (not shown) rotates cam 152 such that lobe 154 is moved towards tab 150. As cam 152 rotates, link 158 pulls on pin 160, to move seal member end 142 toward seal member end 144 and close gap 164. In addition, seal member end 144 moves in a radially inward direction as indicated by an arrow 166. To shift sealing system 140 back to transient operational mode 141, the actuator rotates cam 152 until lobe 154 is oriented away from tab 150. In the exemplary embodiment, the actuator may have any suitable configuration that enables sealing system 140 to function as described herein.

Figure 8:
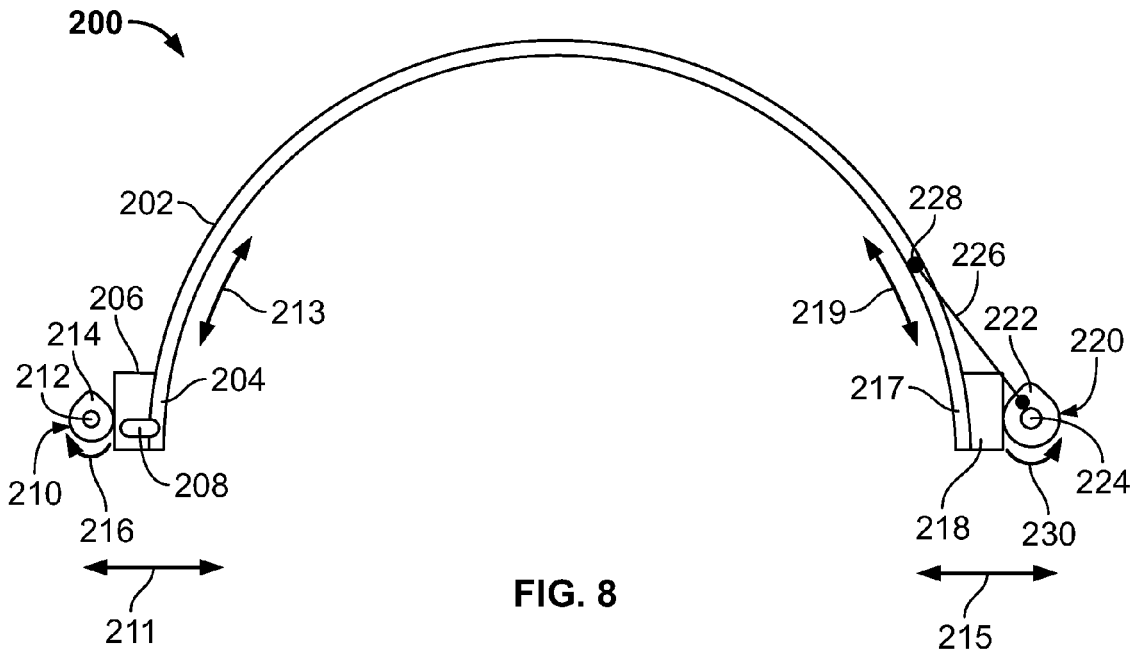
FIG. 8 is a side elevation of an alternative adjustable sealing system that may be used in the steam turbine shown in FIG. 1.

Seal member 32 (shown in FIGS. 4 and 5), seal member 92 (shown in FIG. 6), seal member 111 (shown in FIG. 6), and seal member 147 (shown in FIG. 7) are continuous circumferentially-extending loops with overlapping or adjacent ends. However, at least some known steam turbines 10 (shown in FIG. 1) include a housing 12 (shown in FIG. 1) that is divided along at least a horizontal joint (not shown) into at least two separable components. Accordingly, FIGS. 8 and 9 illustrate respective alternative sealing systems 200 and 300 that are adapted for use with a two-part steam turbine housing (not shown).

In the exemplary embodiment, sealing system 200 (shown in FIG. 8) includes a seal member 202 in a retaining channel (not shown) that is similar to retaining channel 44 shown in FIG. 3. However, the retaining channel that retains seal member 202 extends through an arc of about 180°, or about one-half of a circumference of a turbine (not shown). Seal member end 204 is coupled, for example, via a key 208 to a block 206. Seal member end 204 is secured in the retaining channel to be radially movable in a direction indicated by an arrow 211, but not circumferentially movable in a direction indicated by an arrow 213. In an alternative embodiment (not shown), seal member end 204 may be coupled, for example, via a pin-and-slot arrangement (as shown in FIG. 7), such that a pin coupled to seal member end 204 is received within a slot in a housing structure adjacent to the retaining channel. A cam 210 is coupled to end 204 for rotation around a pin 212, for example. When cam 210 is rotated by an actuator (not shown) in the direction of arrow 216, a cam lobe 214 moves block 206 to push end 204 radially inwardly toward seal member end 217. End 217 is radially movable in a direction indicated by an arrow 215 and circumferentially movable in a direction indicated by an arrow 219. End 217 is coupled to a block 218. A cam 220 is coupled for rotation about a pin 224, and includes an eccentric lobe 222. In addition, cam 220 is coupled via a link 226 to a pin 228 coupled to end 217.

To shift sealing system 200 from a transient operational mode (shown in FIG. 7) to a steady state operational mode (not shown), the actuator (not shown) rotates cam 210 in a direction indicated by arrow 216 to move seal member end 204 radially inwardly towards seal member end 217. Another actuator (not shown) rotates cam 220 in a direction indicated by an arrow 230. As a result, cam lobe 222 moves seal member end 217 radially inwardly towards seal member end 204. Link 226 moves seal member end 217 in a clockwise direction, causing seal member 202 to be tightened within the retaining channel (not shown). Accordingly, sealing system 200 shifts seal member 202 from a transient operational mode (shown in FIG. 8), to a steady state operational mode (not shown). To shift sealing system 200 back to a transient configuration, the previously-described actions are reversed. A spring element (not shown) may be coupled to either or both of seal member ends 204 and 217, to exert a tension force on seal member end 204 and/or seal member end 217, to ensure that during the shift back to the transient operational mode, seal member ends 204 and 217 do not get "stuck" in the steady state operational mode within the retaining channel. The configuration of sealing system 200 shown in FIG. 8 is exemplary only, and the disclosure is not limited thereto. In an alternative embodiment, sealing system 200 may have any suitable configuration that enables sealing system 200 to function as described herein.

Figure 9:
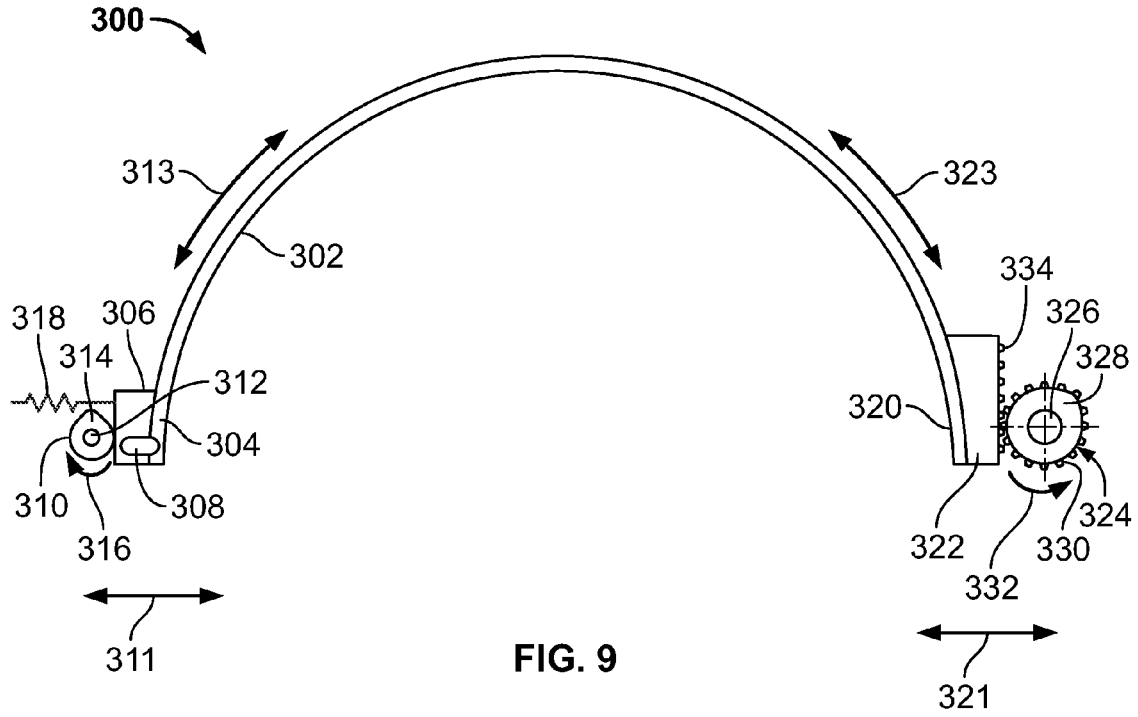
FIG. 9 is a side elevation of another alternative adjustable sealing system that may be used in the steam turbine shown in FIG. 1.

FIG. 9 is a schematic illustration of an alternative sealing system 300. In the exemplary embodiment, a seal member 302 is retained in a retaining channel (not shown) similar to retaining channel 44 shown in FIG. 3. However, the retaining channel for seal member 302 extends through an arc of about 180°, or about one-half of a circumference of a turbine (not shown). In the exemplary embodiment, seal member 302 includes an end 304 coupled to a block 306 for example, via a key 308. A cam 310 is coupled for rotation around an axis 312 relative to block 306. In the exemplary embodiment, end 304 is coupled relative to the retaining channel such that radial movement in a direction of arrow 311 is enabled. However, end 304 is secured against movement in a circumferential direction as shown by arrow 313. Cam 310 includes an eccentric lobe 314. An opposite end 320 of seal member 302 movable both radial radially in the direction of arrow 321 and circumferentially in the direction of arrow 323. End 320 is coupled to a block 322. A cam 324 is coupled for rotation about an axis 326, and includes an eccentric lobe 328 and a plurality of teeth 330. Teeth 330 engage a plurality of teeth 334 oriented on block 322.

To shift sealing system 300 from a transient operational mode (shown in FIG. 9) to a steady state operational mode (not shown), an actuator (not shown) rotates cam 310 in a direction indicated by an arrow 316 to move seal member end 304 radially inwardly toward seal member end 320. Another actuator (not shown) rotates cam 324 in a direction indicated by an arrow 332. Cam 324 moves seal member end 320 circumferentially, and lobe 328 moves seal member end 320 radially inwardly towards seal member end 304. The just-described combined movements cause seal member 302 to be tightened within the retaining channel. Accordingly, sealing system 300 shifts seal member 302 from a transient operational mode (shown in FIG. 9), to a steady state operational mode (not shown). To shift sealing system 300 back to a transient configuration, a reverse procedure is used. A spring element 318 may be coupled to seal member end 204, to exert a tension force on seal member end 204 to prevent seal member 302 from being "stuck" in the steady state operational mode within the retaining channel. Accordingly, spring element 318 ensures that seal member end 204 returns to the transient operational mode shown in FIG. 9. A similar spring element (not shown) may be coupled to seal member end 320. The configuration of sealing system 300 shown in FIG. 9 is exemplary only, and the disclosure is not limited thereto. In an alternative embodiment, sealing system 300 may have any suitable configuration that enables sealing system 300 to function as described herein.

In the embodiments of FIGS. 8 and 9, sealing systems 200 and 300 are configured for use with a turbine 10 (shown in FIG. 1) wherein housing 12 is a two-piece structure, such that each of the housing pieces is provided with a sealing system 200 or 300. In an alternative embodiment, either sealing system 200 or 300 may be configured for use with a turbine having a housing that has any number of components.

Exemplary embodiments of an adjustable sealing system for a steam turbine and methods for assembling same are described above in detail. The adjustable sealing system and methods of assembling same are not limited to the specific embodiments described herein, but rather, components of the adjustable sealing system and/or actions in the assembly method can be utilized independently and separately from other components and/or actions described herein. For example, the adjustable sealing system and methods described herein can also be used in combination with other machines and methods, and are not limited to practice only with steam turbines as described herein. Rather, the exemplary embodiments can be implemented and utilized in connection with many other motor and/or turbine applications.

In contrast to known steam turbine sealing systems, the adjustable sealing systems and methods described herein facilitate the adjustable sealing of steam turbines to address varying clearance conditions that are encountered during various phases of operation of a steam turbine. More particularly, the adjustable sealing systems and methods described herein facilitate providing larger clearances between components of a steam turbine during cooler-temperature conditions that are encountered, e.g., during start-up and/or warm-up phases of steam turbine operation. In addition, the adjustable sealing systems and methods described herein facilitate providing tighter clearances during higher-temperature conditions that are encountered, e.g., during a steady-state phase of steam turbine operation.

Although specific features of various embodiments of the methods and systems described herein may be shown in some drawings and not in others, this is for convenience only. In accordance with the principles of the disclosure, any feature of a drawing may be referenced and/or claimed in combination with any feature of any other drawing.

This written description uses examples to disclose the methods and systems described herein, including the best mode, and also to enable any person skilled in the art to practice the disclosure, including making and using any devices or systems and performing any incorporated methods. The patentable scope of the disclosure is formed by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for providing a seal for use in a turbine, said method comprising:

coupling a housing structure within the turbine such that at least one retaining channel is defined adjacent to a moving turbine component coupled within the turbine;

coupling a seal member within the at least one retaining channel such that a first end of the seal member is secured to the housing structure and such that a second end of the seal member is movable relative to the at least one retaining channel between a first position and at least a second position, wherein a first clearance is defined between the seal member and the moving turbine component when in the first position, and a second clearance is defined between the seal member and the moving turbine component, when in the second position, wherein the first clearance is larger than the second clearance; and coupling a take-up device to the second end of the seal member, to selectively move the second end between the first and second positions.

2. The method in accordance with claim 1, wherein coupling a take-up device comprises coupling one of a lever-actuated device, a linear actuator device, and a sprocket and rack assembly, to the second end of the seal member.

3. The method in accordance with claim 1, wherein said method further comprises overlapping the first and second seal member ends.

4. The method in accordance with claim 3, wherein said method further comprises maintaining the first and second seal member ends in contact with each other where the first and second seal member ends overlap.

5. The method in accordance with claim 1, wherein said method further comprises orienting the first and second seal member ends such that when the second end is in the first position a gap is defined between the first and second ends and when the second end is in the second position, the first and second ends are adjacent to each other.

6. The method in accordance with claim 5, wherein said method further comprises defining an offset in the second end of the seal member wherein when the second end is in the second position, a bottom surface of the first end is substantially flush with a bottom surface of the second end.

7. The method in accordance with claim 1, wherein said method further comprises:

defining the at least one retaining channel to extend substantially around a circumference of the turbine; and configuring the seal member to include a length longer than the circumference of the turbine.

8. The method in accordance with claim 1, wherein said method further comprises:

defining the at least one retaining channel to extend substantially around half a circumference of the turbine; and configuring the seal member to include a length substantially equal to a length of the at least one retaining channel.

9. A system for providing sealing in a turbine, said system comprising:

a housing structure coupled within said turbine such that at least one retaining channel is defined adjacent to a moving turbine component coupled within said turbine;

a seal member coupled within said at least one retaining channel such that a first end of said seal member is secured to said housing structure and such that a second end of the seal member is movable relative to said at least one retaining channel between a first position and at least a second position, wherein a first clearance is defined between said seal member and said moving turbine component when in the first position, and a second clearance is defined between said seal member and the moving turbine component, when in the second position, wherein the first clearance is larger than the second clearance; and a take-up device coupled to the second end of the seal member, to selectively move the second end between the first and second positions.

10. The system in accordance with claim 9, wherein said take-up device comprises a lever-actuated device coupled to said second end of said seal member.

11. The system in accordance with claim 9, wherein said take-up device comprises a linear actuator device coupled to said second end of said seal member.

12. The system in accordance with claim 9, wherein said take-up device comprises a sprocket and rack assembly coupled to said second end of said seal member.

13. The system in accordance with claim 9, wherein said first and second ends of said seal member overlap when said second end is in the first position and when said second end is in the second position.

14. The system in accordance with claim 13, wherein said system further comprises a spring member coupled to said seal member to maintain said first and second ends of said seal member in contact with each other where said first and second ends overlap.

15. The system in accordance with claim 9, wherein said system further comprises an offset defined in said second end of said seal member such that when said second end is in the second position, a bottom surface of said first end is substantially flush with a bottom surface of said second end.

16. The system in accordance with claim 9, wherein said at least one retaining channel extends substantially around a circumference of said turbine and wherein said seal member includes a length longer than the circumference of said turbine.

17. The system in accordance with claim 9, wherein said at least one retaining channel extends around substantially one-half of a circumference of said turbine and wherein said at least one seal member includes a length substantially equal to a length of said at least one retaining channel.

18. The system in accordance with claim 17, wherein said first end is coupled for movement between a first radial position and at least a second radial position relative to said retaining channel and wherein said system comprises an actuator coupled to said first end for moving said first end between the first and second radial positions.

19. A turbine system comprising:

a source of steam;

a steam turbine coupled to said source of steam, wherein said steam turbine includes a housing, a rotor coupled for rotation within said housing, and at least one rotor blade coupled to said rotor; and a load coupled to said rotor;

wherein said steam turbine includes a sub-system for use in sealing in a turbine, said sub-system comprises:

a housing structure coupled within said turbine such that at least one retaining channel is defined adjacent to a moving turbine component coupled within said turbine;

a seal member coupled within said at least one retaining channel such that a first end of said seal member is secured to said housing structure and such that a second end of the seal member is movable relative to said at least one retaining channel between a first position and at least a second position, wherein a first clearance is defined between said seal member and said moving turbine component when in the first position, and a second clearance is defined between said seal member and the moving turbine component, when in the second position, wherein the first clearance is larger than the second clearance; and a take-up device coupled to the second end of the seal member, to selectively move the second end between the first and second positions.

20. The turbine system in accordance with claim 19, wherein said housing is a multi-part housing, and wherein each part of said housing includes a retaining channel and a seal member coupled within said retaining channel.

* * * * *